US007038119B2

(12) United States Patent
Petef

(10) Patent No.: US 7,038,119 B2
(45) Date of Patent: May 2, 2006

(54) DYNAMIC CONTROL OF PROCESSING LOAD IN A WAVETABLE SYNTHESIZER

(75) Inventor: Andrej Petef, Malmö (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 137 days.

(21) Appl. No.: 10/621,459

(22) Filed: Jul. 18, 2003

(65) Prior Publication Data

US 2005/0011341 A1 Jan. 20, 2005

(51) Int. Cl.
*G10H 1/00* (2006.01)

(52) U.S. Cl. ..... 84/604; 84/602; 84/603; 718/105; 712/220

(58) Field of Classification Search ..... 84/600–608; 718/105; 712/220
See application file for complete search history.

(56) References Cited

U.S. PATENT DOCUMENTS 5,808,221 A * 9/1998 Ashour et al. ..... 84/603
5,850,049 A * 12/1998 Kamiya ..... 84/607

FOREIGN PATENT DOCUMENTS

EP 0951009 A1 10/1999
EP 1087372 A2 3/2001
EP 1109149 A2 6/2001

OTHER PUBLICATIONS

PCT International Search Report dated Dec. 10, 2004 in connection with International Application No. PCT/EP2004/006669.
PCT Written Opinion dated Dec. 10, 2004 in connection with International Application No. PCT/EP2004/006669.

* cited by examiner

*Primary Examiner*—Marlon T. Fletcher
*Assistant Examiner*—David S. Warren
(74) *Attorney, Agent, or Firm*—Potomac Patent Group PLLC

(57) ABSTRACT

A wavetable synthesizer is controlled by dynamically determining a present CPU loading estimate associated with a song being played by the wavetable synthesizer. An interpolation degree is determined based on the present CPU loading estimate, and the wavetable synthesizer is adjusted to utilize the interpolation degree when playing the song. This technique can be used to enable the wavetable synthesizer to generate a varying number of simultaneous voices at, for example, a highest-quality without exceeding a predetermined maximum permissible CPU load limit.

27 Claims, 2 Drawing Sheets

DYNAMIC CONTROL OF PROCESSING LOAD IN A WAVETABLE SYNTHESIZER

BACKGROUND

The present invention relates to the generation of sounds by means of a wavetable synthesizer, and more particularly to the control of the processing load imposed by a wavetable synthesizer.

The creation of musical sounds using electronic synthesis methods dates back at least to the late nineteenth century. From these origins of electronic synthesis until the 1970's, analog methods were primarily used to produce musical sounds. Analog music synthesizers became particularly popular during the 1960's and 1970's with developments such as the analog voltage controlled patchable analog music synthesizers, invented independently by Don Buchla and Robert Moog. As development of the analog music synthesizer matured and its use spread throughout the field of music, it introduced the musical world to a new class of timbres.

However, analog music synthesizers were constrained to using a variety of modular elements. These modular elements included oscillators, filters, multipliers and adders, all interconnected with telephone style patch cords. Before a musically useful sound could be produced, analog synthesizers had to be programmed by first establishing an interconnection between the desired modular elements and then laboriously adjusting the parameters of the modules by trial and error. Because the modules used in these synthesizers tended to drift with temperature change, it was difficult to store parameters and faithfully reproduce sounds from one time to another time.

Around the same time that analog musical synthesis was coming into its own, digital computing methods were being developed at a rapid pace. By the early 1980's, advances in computing made possible by Very Large Scale Integration (VLSI) and digital signal processing (DSP) enabled the development of practical digital based waveform synthesizers. Since then, the declining cost and decreasing size of memories have made the digital synthesis approach to generating musical sounds a popular choice for use in personal computers and electronic musical instrument applications.

One type of digital based synthesizer is the wavetable synthesizer. The wavetable synthesizer is a sampling synthesizer in which one or more real musical instruments are "sampled," by recording and digitizing a sound produced by the instrument(s), and storing the digitized sound into a memory. The memory of a wavetable synthesizer includes a lookup table in which the digitized sounds are stored as digitized waveforms. Sounds are generated by "playing back" from the wavetable memory, to a digital-to-analog converter (DAC), a particular digitized waveform.

The basic operation of a sampling synthesizer is to playback digitized recordings of entire musical instrument notes under the control of a person, computer or some other means. Playback of a note can be triggered by depressing a key on a musical keyboard, from a computer, or from some other controlling device. When it is desired to store a particular sequence of desired musical events that are to be rendered by a sampling synthesizer, a standard control language, such as the Musical Instrument Digital Interface (MIDI), may be used. While the simplest samplers are only capable of reproducing one note at a time, more sophisticated samplers can produce polyphonic (multi-tone), multi-timbral (multi-instrument) performances.

Data representing a sound in a wavetable memory may be created using an analog-to-digital converter (ADC) to sample, quantize and digitize the original sound at a successive regular time interval (i.e., the sampling interval, TS). The digitally encoded sound is stored in an array of wavetable memory locations that are successively read out during a playback operation.

One technique used in wavetable synthesizers to conserve sample memory space is the "looping" of stored sampled sound segments. A looped sample is a short segment of a wavetable waveform stored in the wavetable memory that is repetitively accessed (e.g., from beginning to end) during playback. Looping is particularly useful for playing back an original sound or sound segment having a fairly constant spectral content and amplitude. A simple example of this is a memory that stores one period of a sine wave such that the endpoints of the loop segment are compatible (i.e., at the endpoints the amplitude and slope of the waveform match to avoid a repetitive "glitch" that would otherwise be heard during a looped playback of an unmatched segment). A sustained note may be produced by looping the single period of a waveform for the desired length of duration time (e.g., by depressing the key for the desired length, programming a desired duration time, etc.). However, in practical applications, for example, for an acoustic instrument sample, the length of a looped segment would include many periods with respect to the fundamental pitch of the instrument sound. This avoids the "periodicity" effect of a looped single period waveform that is easily detectable by the human ear, and improves the perceived quality of the sound (e.g., the "evolution" or "animation" of the sound).

The sounds of many instruments can be modeled as consisting of two major sections: the "attack" (or onset) section and the "sustain" section. The attack section is the initial part of a sound, wherein amplitude and spectral characteristics of the sound may be rapidly changing. For example, the onset of a note may include a pick snapping a guitar string, the chiff of wind at the start of a flute note, or a hammer striking the strings of a piano. The sustain section of the sound is that part of the sound following the attack, wherein the characteristics of the sound are changing less dynamically. A great deal of memory is saved in wavetable synthesis systems by storing only a short segment of the sustain section of a waveform, and then looping this segment during playback.

Amplitude changes that are characteristic of a particular or desired sound may be added to a synthesized waveform signal by multiplying the signal with a decreasing gain factor or a time varying envelope function. For example, for an original acoustic string sound, signal amplitude variation naturally occurs via decay at different rates in various sections of the sound. In the onset of the acoustic sound (i.e., in the attack part of the sound), a period of decay may occur shortly after the initial attack section. A period of decay after a note is "released" may occur after the sound is terminated (e.g., after release of a depressed key of a music keyboard). The spectral characteristics of the acoustic sound signal may remain fairly constant during the sustain section of the sound, however, the amplitude of the sustain section also may (or may not) decay slowly. The forgoing describes a traditional approach to modeling a musical sound called the Attack-Decay-Sustain-Release (ADSR) model, in which a waveform is multiplied with a piecewise linear envelope function to simulate amplitude variations in the original sounds.

In order to minimize sample memory requirements, wavetable synthesis systems have utilized pitch shifting, or pitch transposition techniques, to generate a number of different notes from a single sound sample of a given instrument. Two types of methods are mainly used in pitch shifting: asynchronous pitch shifting and synchronous pitch shifting.

In asynchronous pitch shifting, the clock rate of each of the DAC converters used to reproduce a digitized waveform is changed to vary the waveform frequency, and hence its pitch. In systems using asynchronous pitch shifting, each channel of the system is required to have a separate DAC. Each of these DACs has its own clock whose rate is determined by the requested frequency for that channel. This method of pitch shifting is considered asynchronous because each output DAC runs at a different clock rate to generate different pitches. Asynchronous pitch shifting has the advantages of simplified circuit design and minimal pitch shifting artifacts (as long as the analog reconstruction filter is of high quality). However, asynchronous pitch shifting methods have several drawbacks. First, a DAC would be needed for each channel, which increases system cost with increasing channel count. Another drawback of asynchronous pitch shifting is the inability to mix multiple channels for further digital post processing such as reverberation. Asynchronous pitch shifting also requires the use of complex and expensive tracking reconstruction filters-one for each channel-to track the sample playback rate for the respective channels.

In synchronous pitch shifting techniques currently being utilized, the pitch of the wavetable playback data is changed using sample rate conversion algorithms. These techniques accomplish sample rate conversion essentially by generating, from the stored sample points, a different number of sample points which, when accessed at a standard clock rate, generate the desired pitch during playback. For example, if sample memory accesses occur at a fixed rate, and if a pointer is used to address the sample memory for a sound, and the pointer is incremented by one after each access, then the samples for this sound would be accessed sequentially, resulting in some particular pitch. If the pointer increment is two rather than one, then only every second sample would be played (i.e., the effective number of samples is cut in half), and the resulting pitch would be shifted up by one octave (i.e., the frequency would be doubled). Thus, a pitch may be adjusted to an integer number of higher octaves by multiplying the index, n, of a discrete time signal x[n] by a corresponding integer amount a and playing back (reconstructing) the signal $x_{up}[n]$ at a "resampling rate" of a·n:

$$x_{up}[n]=x[a\cdot n]$$

To shift downward in pitch, it is necessary to expand the number of samples from the number actually stored in the sample memory. To accomplish this, additional "sample" points (e.g., one or more zero values) may be introduced between values of the decoded sequential data of the stored waveform. That is, a discrete time signal x[n] may be supplemented with additional values in order to approximate a resampling of the continuous time signal x(t) at a rate that is increased by a factor L:

$$x_{down}[n]=x[n/L],\ n=0,\ \pm L,\ \pm 2L,\ \pm 3L,\ \ldots;\ \text{otherwise},\ x_{down}[n]=0.$$

When the resultant sample points, $x_{down}[n]$, are played back at the original sampling rate, the pitch will have been shifted downward.

While the foregoing illustrates how the pitch may be changed by scaling the index of a discrete time signal by an integer amount, this allows only a limited number of pitch shifts. This is because the stored sample values represent a discrete time signal, x[n], and a scaled version of this signal, x[a·n] or x[n/b], cannot be defined with a or b being non-integers. Hence, more generalized sample rate conversion methods have been developed to allow for more practical pitch shifting increments, as described in the following.

In a more general case of sample rate conversion, the sample memory address pointer would consist of an integer part and a fractional part, and thus the increment value could be a fractional number of samples. The memory pointer is often referred to as a "phase accumulator" and the increment value is called the "phase increment." The integer part of the phase accumulator is used to address the sample memory and the fractional part is used to maintain frequency accuracy.

Different algorithms for changing the pitch of a tabulated signal that allow fractional increment amounts have been proposed. One category of such algorithms involves the use of interpolation to generate a synthesized sample point from the actually stored adjacent sample points when the memory pointer points to an address that lies between two actual memory locations. That is, instead of ignoring the fractional part of the address pointer when determining the value to be sent to the DAC (such as in the known "drop sample algorithm"), interpolation techniques perform a mathematical interpolation between available data points in order to obtain a value to be used in playback. It is well-known that the optimum interpolator uses a sin(x)/x function and that such an interpolator is non-causal and requires an infinite number of calculations. Consequently, sub-optimal interpolation methods have been developed. A sub-optimal interpolation generates distortion (artifacts) due to a portion of the signal being folded back at the Nyquist frequency $F_s/2$ ($F_s$ being the sampling rate used when the table sequence was recorded). This distortion is perceived as annoying and has to be controlled.

The interpolation degree, defined as the number of wavetable samples used in the interpolation, is a parameter that sets the performance of the synthesizer. The higher the degree that is used, the lower the distortion present in the generated signal. However, a high interpolation degree costs complexity. For example, the computational complexity using the traditional truncated sin(x)/x interpolation algorithm grows linearly with the interpolation degree. Synthesizers presently available commonly use interpolation degrees on the order of ten, since this results in a good trade-off between complexity and sound quality.

The discussion so far has focused on problems associated with generating, from a stored set of samples, a single "voice" of sound at a desired pitch. Another aspect that contributes to computational complexity is the number of simultaneous sounds that can be generated in real-time. In a MIDI Synthesizer, this is called the number of voices. For example, in order to synthesize guitar music one needs up to six voices, since there are six strings on this instrument that can be played in various combinations.

It is desirable to be able to simultaneously reproduce a large number of voices, since more voices imply a higher degree of polyphony, and therefore also the possibility of generating more complex music. Low-end systems may require, for example, at least 24 voices, and a high performance synthesizer for musicians may require the capability of generating up to 128 simultaneous voices.

Voice generation is often implemented in a synthesizer using one or several central processing units (CPUs). The computational power of the CPU imposes a limit on the number of voices that can be executed.

In some applications, such as in a mobile communications terminal, the computational power required for maintaining a sufficient interpolation degree is lacking if, at the same time, it is desired to provide a high level of polyphony. For example, it is difficult to implement levels of polyphony as high as 40 voices or more, using an interpolation degree around ten, without the use of dedicated hardware accelerators.

Unlike the decoding of many other media content types, the computational load on the CPU varies greatly during the execution of a MIDI song. (In this description, the word "song" is used generically to refer not only to music in the traditional sense, but also to any sounds that can be encoded for automated reproduction by means of a control language such as MIDI.) This is because the complexity of a MIDI song decoding depends on such parameters as the number of active voices, the original sample rate of the table sequence and the word length of those samples.

There is therefore a need to be able to control the peaks of CPU loading so that they do not exceed the maximum allowed number of CPU cycles as measured, for example, in Millions of Instructions Per Second (MIPS). Exceeding this maximum risks a system crash.

There is also a need to be able to set the maximum allowed number of MIPS to be dedicated to song decoding so that it suits the available resources in a particular system. Such a capability would make a synthesizer implementation easily portable into a variety of systems, such as different mobile platforms with different CPU capabilities.

SUMMARY

It should be emphasized that the terms "comprises" and "comprising", when used in this specification, are taken to specify the presence of stated features, integers, steps or components; but the use of these terms does not preclude the presence or addition of one or more other features, integers, steps, components or groups thereof.

In accordance with one aspect of the present invention, the foregoing and other objects are achieved in methods, apparatuses, and computer-readable storage media for controlling a wavetable synthesizer. In one aspect of the invention, a wavetable synthesizer is controlled by dynamically determining a present CPU loading estimate associated with a song being played by the wavetable synthesizer. An interpolation degree is determined based on the present CPU loading estimate, and the wavetable synthesizer is adjusted to utilize the interpolation degree when playing the song.

In another aspect of the invention, determining the interpolation degree based on the present CPU load estimate comprises comparing the present CPU loading estimate with a predefined permissible maximum CPU load limit and determining the interpolation degree based on the comparison. In some embodiments, determining the interpolation degree based on the comparison comprises determining the interpolation degree, based on the comparison, so as to provide a best quality of song synthesis without exceeding the predefined permissible maximum CPU load limit.

In some embodiments, determining the interpolation degree based on the comparison comprises halting song synthesis, based on the comparison, in order to avoid song synthesis at a quality that is below a predetermined threshold.

In some embodiments, the quality of song synthesis is increased (e.g., by adjusting the interpolation degree to a higher value) when the present CPU loading estimate is reduced. Similarly, the quality of song synthesis may be reduced (e.g., by adjusting the interpolation degree to a lower value) when the present CPU loading estimate is increased.

In yet another aspect of the invention that may be incorporated into some embodiments, dynamically determining the present CPU loading estimate associated with the song being played by the wavetable synthesizer can comprise, while playing the song, detecting that a new voice has been set active; determining an additional CPU load value that corresponds to the new voice; and adding the additional CPU load value to an accumulated CPU loading estimate that represents the present CPU loading estimate. In a similar aspect that may be incorporated into some embodiments, dynamically determining the present CPU loading estimate associated with the song being played by the wavetable synthesizer can comprise, while playing the song, detecting that an existing voice has been newly deactivated; determining a CPU load value that corresponds to the newly deactivated voice; and subtracting the corresponding CPU load value from an accumulated CPU loading estimate that represents the present CPU loading estimate.

BRIEF DESCRIPTION OF THE DRAWINGS

The objects and advantages of the invention will be understood by reading the following detailed description in conjunction with the drawings in which.

DETAILED DESCRIPTION

Figure 1:
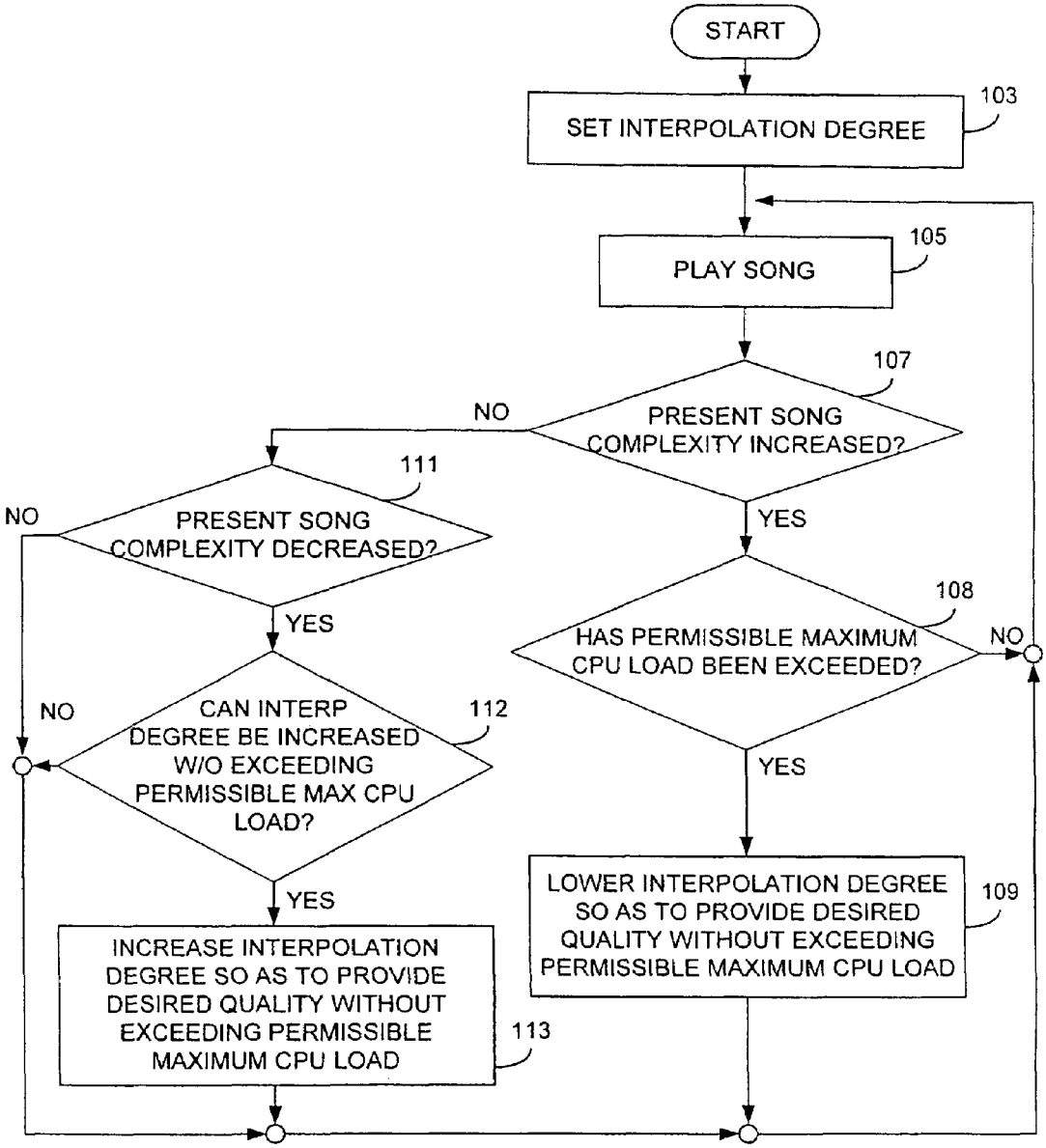
FIG. 1 is a flow chart of an automated process in accordance with an aspect of the invention.

The various features of the invention will now be described with reference to the figures, in which like parts are identified with the same reference characters.

The various aspects of the invention will now be described in greater detail in connection with a number of exemplary embodiments. To facilitate an understanding of the invention, many aspects of the invention are described in terms of sequences of actions to be performed by elements of a computer system. It will be recognized that in each of the embodiments, the various actions could be performed by specialized circuits (e.g., discrete logic gates interconnected to perform a specialized function), by program instructions being executed by one or more processors, or by a combination of both. Moreover, the invention can additionally be considered to be embodied entirely within any form of computer readable carrier, such as solid-state memory, magnetic disk, optical disk or carrier wave (such as radio frequency, audio frequency or optical frequency carrier waves) containing an appropriate set of computer instructions that would cause a processor to carry out the techniques described herein. Thus, the various aspects of the invention may be embodied in many different forms, and all such forms are contemplated to be within the scope of the invention. For each of the various aspects of the invention, any such form of embodiments may be referred to herein as "logic configured to" perform a described action, or alternatively as "logic that" performs a described action.

In accordance with an aspect of the invention, one or more of the earlier-mentioned problems are addressed by providing methods and apparatuses that dynamically control interpolation complexity of the wavetable synthesizer. For a given environment, a maximum amount of available CPU loading is defined (i.e., available for use by the wavetable synthesizer). The CPU loading can, for example, be specified in MIPS, although this is not essential to the invention. Then during the performance (i.e., decoding) of the encoded sounds, the interpolation degree is dynamically changed in response to the complexity of the portion of the song being decoded. In this way, the actual CPU loading imposed by the wavetable synthesizer is made to stay below the defined maximum amount of available CPU loading.

In the following description, an exemplary embodiment of the invention is described in detail. In this embodiment, the number of voices that are presently to be simultaneously executed is taken as the measure of complexity of the portion of the song being decoded. It will be recognized, however, that in alternative embodiments, other indicia could be used to detect present song complexity.

FIG. 1 is a flow chart of an embodiment of the invention. At the start of playing a song, the wavetable synthesizer's interpolation degree is set so as to provide a desired quality (e.g., a best quality) without exceeding the maximum permissible CPU load (step 103).

After the interpolation degree is set, the song is played (step 105). The strategy adopted in this process is as follows: When being scheduled to decode a less complex content, the interpolator algorithm will be set to run a higher interpolation degree, and thus a higher amount of CPU loading (e.g., a higher MIPS number), in order to perform a higher quality output. Conversely, when being scheduled to decode a more complex content, the interpolator algorithm is set to run a lower interpolation degree, and thus a lower CPU loading (e.g., a lower MIPS number), in order to make sure that processing stays below the maximum permissible CPU load limit. This strategy makes the synthesizer run a more constant amount of CPU loading, and therefore makes the decision algorithm act as a dynamic CPU load limiter.

Thus, during the process of playing the song, the present level of song complexity is monitored. If the present song complexity increases ("YES" path out of decision block 107), then it is determined whether this increase will result in the permissible maximum CPU load limit being exceeded (decision block 108). If it will, then the interpolation degree is lowered so as to continue to provide a desired (e.g., best) quality without exceeding the maximum permissible CPU load limit (step 109). The song then continues to be played (return to step 105). If the increased song complexity will not result in exceeding the maximum permissible CPU load limit ("NO" path out of decision block 108), then the song simply continues to be played (return to step 105).

If the present song complexity has not increased ("NO" path out of decision block 107) but it is detected that the present song complexity has decreased ("YES" path out of decision block 111), then it is determined whether this decrease in complexity will permit the interpolation degree to be increased without exceeding the permissible maximum CPU load limit (decision block 112). If the answer is "yes" ("YES" path out of decision block 112), then the interpolation degree is increased so as to continue to provide a desired (e.g., best) quality without exceeding the maximum permissible CPU load limit (step 113). The song then continues to be played (return to step 105). If the interpolation degree cannot be increased without exceeding the permissible maximum CPU load limit ("NO" path out of decision block 112), then the song simply continues to be played (return to step 105).

Of course, if the present song complexity remains unchanged ("NO" paths out of decision blocks 107 and 111), then the interpolation complexity remains unchanged, and the song continues to be played (return to step 105).

When following the above-described strategy, the level of distortion generated by a lower interpolation degree grows as the total decoding complexity increases. However, this appears not to be a problem for the following reason.

It is well known that human hearing has a so-called masking property. There are two kinds of masking effects: temporal masking and frequency masking. Both masking effects make any distortion that is adjacent (in time or in frequency) to a distinct and more powerful signal less perceptible (if not entirely imperceptible).

When the total complexity of the decoding increases, it also implies a large number of voices being simultaneously active. Therefore, the masking threshold for interpolation distortion also increases, thereby making it possible to allow a lower degree in the interpolation algorithm in the synthesizer without jeopardizing the audio quality.

The principles described above will now be illustrated in the following example. Assume that a 40-voice synthesizer is to be implemented. Usually individual voices differ in complexity because they are processed at different sampling rates or word lengths. The complexity of each type of voice should be carefully estimated and tabulated prior to execution. The maximum permissible level of CPU loading for the particular system to be implemented is also predefined, and for the sake of example will be assumed to be 100 MIPS.

Since the complexity of each voice to be executed is now known, the actual amount of CPU loading imposed by generating all 40 voices at the highest desired level of interpolation degree is determined. In this hypothetical, assume that it is estimated that 150 MIPS of CPU loading are imposed when all 40 voices are generated at a highest quality interpolation degree of 11. With the maximum permissible CPU loading set to 100 MIPS, it is apparent that it will be necessary to process at a significantly lower level of complexity.

Suppose, for the sake of example, that the synthesizer executes at a complexity that is proportional to the interpolation degree. This would result in the relative execution complexities as follows:

| Interpolation degree | Relative complexity |
|---|---|
| 11 | 100% |
| 9 | 81% |
| 7 | 63% |
| 5 | 45% |
| 3 | 27% |
| Linear Interpolation | 9% |

Of course, if the complexity is related to the interpolation degree by a function that is different from the simple proportion shown above, a different table can readily be derived.

The conventional non-limiting approach would result in overloading the CPU by 50 MIPS, which is unacceptable. By contrast, the inventive technique can Choose a highest-quality interpolation degree of 7, which results in 150*0.63=94.5 MIPS, which is below the 100 MIPS maximum permissible CPU loading limit. In alternative embodiments, an even lower interpolation degree could be selected if the corresponding decreased quality of sound reproduction were tolerable.

In general, a song may have a dynamically varying level of polyphony. Thus, the estimated CPU loading at the highest interpolation degree (which is interpolation degree 11 in our example) will vary as well. With the assumed pre-defined maximum permissible CPU loading limit of 100 MIPS, the following table can be derived, which shows which interpolation selection is best for given conditions:

| Estimated CPU Loading at interpolation degree 11 | Interpolation Degree that should be selected | Defined level for automatically selecting this degree |
|---|---|---|
| 370–1100 | Linear_Interpolation | Lin_Int_Limit = 1100 |
| 222–370 | 3 | 3_Point_Limit = 370 |
| 159–222 | 5 | 5_Point_Limit = 222 |
| 123–159 | 7 | 7_Point_Limit = 159 |
| 100–123 | 9 | 9_Point_Limit = 123 |
| <100 | 11 | 11_Point_Limit = 100 |

The following pseudo-code shows an exemplary embodiment of an algorithm for automatically selecting a highest-quality permissible interpolation degree in accordance with an aspect of the invention:

IF Estimated_CPU_loading_at_interpolation_degree_11< 11_Point_limit Interp_Degree=11
ELSE IF Estimated_CPU_loading_at_interpolation_degree_11< 9_Point_limit Interp_Degree=9
ELSE IF Estimated_CPU_loading_at_interpolation_degree_11< 7_Point_limit Interp_Degree=7
ELSE IF Estimated_CPU_loading_at_interpolation_degree_11< 5_Point_limit Interp_Degree=5
ELSE IF Estimated_CPU_loading_at_interpolation_degree_11< 3_Point_limit Interp_Degree=3
ELSE IF Estimated_CPU_loading_at_interpolation_degree_11< Lin_Int_limit Interp_Degree=Linear_Interpolation
ELSE
Do_Not_Execute;

In this explicit example, a 7-point interpolation degree would have been used when generating music requiring a 150 MIPS level of CPU load at the normal 11-point interpolation. The interpolation degree would have decreased without audibly increasing artifacts/distortion. Also, the computational load in this example will never exceed the desired MIPS limit. It will be noted that if even selection of the simple linear interpolation method would cause the synthesizer to exceed the maximum permissible CPU loading limit, then the decision is made not to execute at all in order to avoid overloading the CPU. In alternative embodiments, even if selection of some of the lowest interpolation degrees will not cause the synthesizer to exceed the maximum permissible CPU loading limit, it may nonetheless be decided not to execute at all if the audio quality is perceived to become annoying at these levels.

Figure 2:
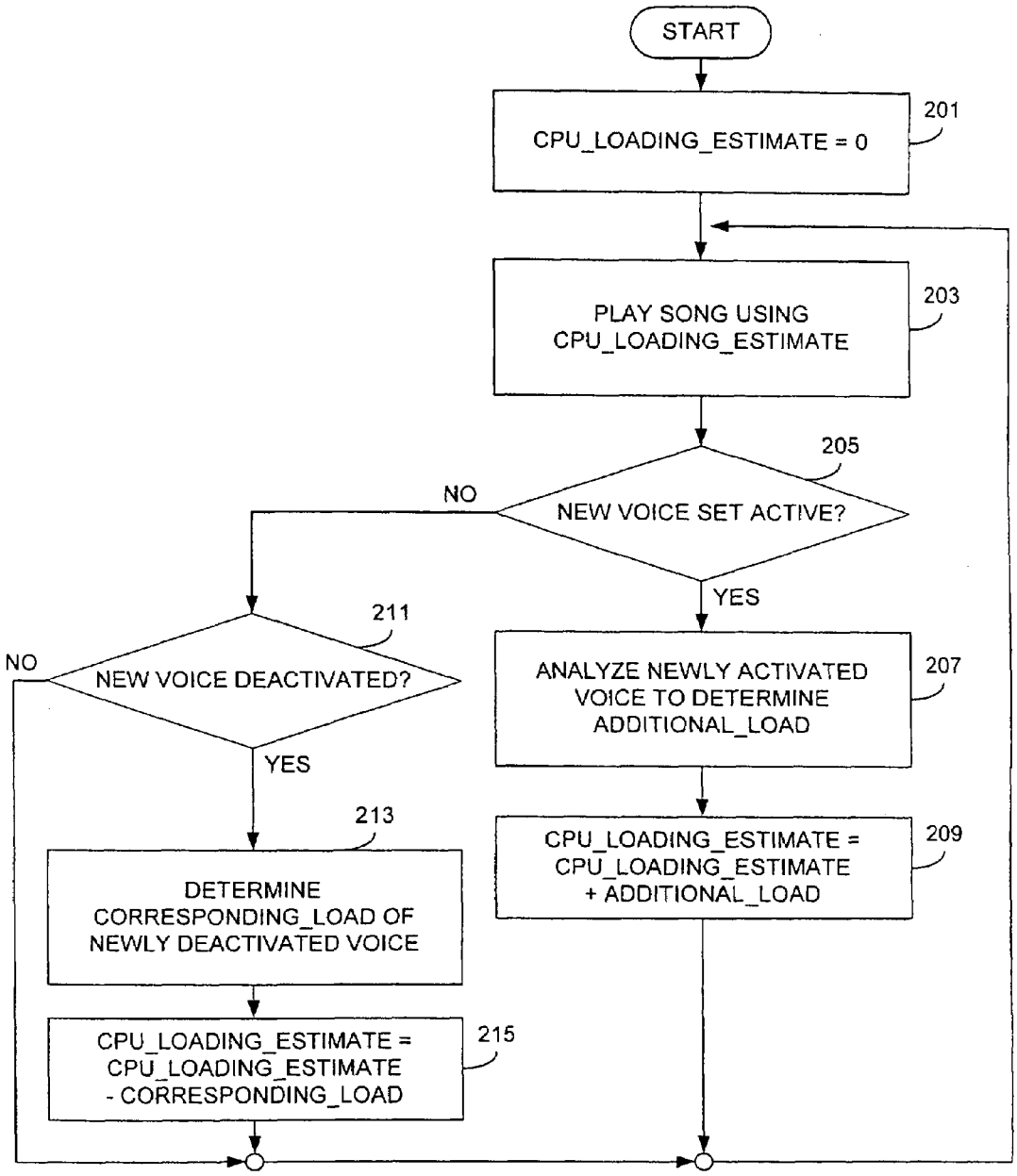
FIG. 2 is a flow chart of an automated CPU loading estimation technique in accordance with an aspect of the invention.

The technique for estimating the current CPU loading at the maximum interpolation degree (e.g., interpolation degree 11) can be performed before every execution of the software module. This is a very straightforward approach. However, a faster estimation technique will now be described in connection with the flowchart of FIG. 2. In this technique, an accumulating estimate ("CPU_LOADING_ESTIMATE") is provided. The accumulating estimate is only updated whenever a synthesizer voice is activated or deactivated, since in practice this is the only time the estimate will change. Referring now to the figure, CPU_LOADING_ESTIMATE is initially set equal to zero (step 201) since at the beginning of the song there are no voices active. The song is then played (step 203). This includes dynamically detecting any changes in the number of voices that are to be simultaneously generated. If it is detected that a new voice has been set active (e.g., by means of a MIDI KeyOn event) ("YES" path out of decision block 205), the new voice is analyzed to determine its corresponding additional CPU load ("ADDITIONAL_LOAD") (step 207). This additional CPU load value is then added to the existing accumulated CPU loading estimate (step 209). Playing of the song then continues as before (return to step 203).

If no new voice has been activated ("NO" path out of decision block 205), but instead it has been detected that a voice has been deactivated ("YES" path out of decision block 211), the corresponding CPU load associated with the newly deactivated voice is determined (step 213) and then subtracted from the existing accumulated CPU loading estimate (step 215). Playing of the song then continues as before (return to step 203).

Several additional points will be noted. While the above description referred to analyzing a voice to determine its corresponding CPU loading estimate, in some embodiments it may be possible to determine ahead of time the corresponding CPU loading estimate associated with each possible voice. In such embodiments, it may be beneficial to store these predetermined values in a table, so that the step of "analyzing" reduces to simply looking up the appropriate value in a table. Furthermore (especially in, but not limited to, embodiments in which all possible CPU loading estimates are not predetermined and stored in a table), while it is possible to determine the corresponding CPU load associated with the newly deactivated voice by performing an analysis of this voice, this same analysis will already have been performed at the time that the voice was first activated. Thus, if memory capacity permits, it may be more efficient to store these values at the time they are first determined, so that they can be retrieved when needed at the time of deactivation.

If the just-described estimation technique is followed, the CPU loading estimates will likely be less often updated, and will likely result in fewer CPU cycles being used for the estimation method.

The invention thus provides an intelligent approach that limits the computational load in a wavetable-based synthesizer without lowering the perceived sound quality. It also provides means for accurately controlling the maximum load that the synthesizer imposes on the CPU. This is of vital importance in systems such as mobile terminals (e.g., cellular telephones) that have only limited available processing power, and yet which may find it desirable to provide a high level of polyphony (e.g., up to 40 simultaneous voices for producing polyphonic ring signals).

The invention has been described with reference to a particular embodiment. However, it will be readily apparent to those skilled in the art that it is possible to embody the invention in specific forms other than those of the preferred embodiment described above. This may be done without departing from the spirit of the invention. The preferred embodiment is merely illustrative and should not be considered restrictive in anyway. The scope of the invention is given by the appended claims, rather than the preceding description, and all variations and equivalents which fall within the range of the claims are intended to be embraced therein.

What is claimed is:

1. A method of controlling a wavetable synthesizer, the method comprising:

dynamically determining a present CPU loading estimate associated with a song being played by the wavetable synthesizer;

determining an interpolation degree based on the present CPU loading estimate; and adjusting the wavetable synthesizer to utilize the interpolation degree when playing the song, wherein dynamically determining the present CPU loading estimate associated with the song being played by the wavetable synthesizer comprises:

while playing the song, detecting that an existing voice has been newly deactivated;

determining a CPU load value that corresponds to the newly deactivated voice; and subtracting the corresponding CPU load value from an accumulated CPU loading estimate that represents the present CPU loading estimate.

2. The method of claim 1, wherein determining the interpolation degree based on the present CPU load estimate comprises:

comparing the present CPU loading estimate with a predefined permissible maximum CPU load limit and determining the interpolation degree based on said comparison.

3. The method of claim 2, wherein determining the interpolation degree based on said comparison comprises:

determining the interpolation degree, based on said comparison, so as to provide a best quality of song synthesis without exceeding the predefined permissible maximum CPU load limit.

4. The method of claim 2, wherein determining the interpolation degree based on said comparison comprises:

halting song synthesis, based on said comparison, in order to avoid song synthesis at a quality that is below a predetermined threshold.

5. The method of claim 1, comprising:

adjusting the interpolation degree to a higher value in response to detecting that the present CPU loading estimate has decreased.

6. The method of claim 1, comprising:

adjusting the interpolation degree to a lower value in response to detecting that the present CPU loading estimate has increased.

7. The method of claim 1, wherein determining the interpolation degree based on the present CPU load estimate comprises:

comparing the present CPU loading estimate with one or more predefined CPU load levels, and determining the interpolation degree based on said one or more comparisons, wherein each of the one or more predefined CPU load levels corresponds to a corresponding one of a set of one or more interpolation degrees.

8. The method of claim 1, wherein dynamically determining the present CPU loading estimate associated with the song being played by the wavetable synthesizer comprises:

while playing the song, detecting that a new voice has been set active;

determining an additional CPU load value that corresponds to the new voice; and adding the additional CPU load value to an accumulated CPU loading estimate that represents the present CPU loading estimate.

9. The method of claim 8, wherein determining the additional CPU load value that corresponds to the new voice comprises:

using an identity of the new voice to access and retrieve the additional CPU load value from a memory.

10. An apparatus for controlling a wavetable synthesizer, the apparatus comprising:

logic that dynamically determines a present CPU loading estimate associated with a song being played by the wavetable synthesizer;

logic that determines an interpolation degree based on the present CPU loading estimate; and logic that adjusts the wavetable synthesizer to utilize the interpolation degree when playing the song, wherein the logic that dynamically determines the present CPU loading estimate associated with the song being played by the wavetable synthesizer comprises:

logic that detects that an existing voice has been newly deactivated while playing the song;

logic that determines a CPU load value that corresponds to the newly deactivated voice; and logic that subtracts the corresponding CPU load value from an accumulated CPU loading estimate that represents the present CPU loading estimate.

11. The apparatus of claim 10, wherein the logic that determines the interpolation degree based on the present CPU load estimate comprises:

logic that compares the present CPU loading estimate with a predefined permissible maximum CPU load limit and determines the interpolation degree based on said comparison.

12. The apparatus of claim 11, wherein the logic that determines the interpolation degree based on said comparison comprises:

logic that determines the interpolation degree, based on said comparison, so as to provide a best quality of song synthesis without exceeding the predefined permissible maximum CPU load limit.

13. The apparatus of claim 11, wherein the logic that determines the interpolation degree based on said comparison comprises:

logic that halts song synthesis, based on said comparison, in order to avoid song synthesis at a quality that is below a predetermined threshold.

14. The apparatus of claim 10, comprising:

logic that adjusts the interpolation degree to a higher value in response to detecting that the present CPU loading estimate has decreased.

15. The apparatus of claim 10, comprising:

logic that adjusts the interpolation degree to a lower value in response to detecting that the present CPU loading estimate has increased.

16. The apparatus of claim 10, wherein the logic that determines the interpolation degree based on the present CPU load estimate comprises:

logic that compares the present CPU loading estimate with one or more predefined CPU load levels, and determines the interpolation degree based on said one or more comparisons, wherein each of the one or more predefined CPU load levels corresponds to a corresponding one of a set of one or more interpolation degrees.

17. The apparatus of claim 10, wherein the logic that dynamically determines the present CPU loading estimate associated with the song being played by the wavetable synthesizer comprises:

logic that detects that a new voice has been set active while playing the song;

logic that determines an additional CPU load value that corresponds to the new voice; and logic that adds the additional CPU load value to an accumulated CPU loading estimate that represents the present CPU loading estimate.

18. The apparatus of claim 17, wherein the logic that determines the additional CPU load value that corresponds to the new voice comprises:

logic that uses an identity of the new voice to access and retrieve the additional CPU load value from a memory.

19. A computer-readable storage medium having stored therein one or more instructions for causing a processor to control a wavetable synthesizer, the instructions causing the processor to perform:

dynamically determining a present CPU loading estimate associated with a sons being played by the wavetable synthesizer;

determining an interpolation degree based on the present CPU loading estimate; and adjusting the wavetable synthesizer to utilize the interpolation degree when playing the song, wherein dynamically determining the present CPU loading estimate associated with the song being played by the wavetable synthesizer comprises:

while playing the song, detecting that an existing voice has been newly deactivated;

determining a CPU load value that corresponds to the newly deactivated voice; and subtracting the corresponding CPU load value from an accumulated CPU loading estimate that represents the present CPU loading estimate.

20. The computer-readable storage medium of claim 19, wherein determining the interpolation degree based on the present CPU load estimate comprises:

comparing the present CPU loading estimate with a predefined permissible maximum CPU load limit and determining the interpolation degree based on said comparison.

21. The computer-readable storage medium of claim 20, wherein determining the interpolation degree based on said comparison comprises:

determining the interpolation degree, based on said comparison, so as to provide a best quality of song synthesis without exceeding the predefined permissible maximum CPU load limit.

22. The computer-readable storage medium of claim 20, wherein determining the interpolation degree based on said comparison comprises:

halting song synthesis, based on said comparison, in order to avoid song synthesis at a quality that is below a predetermined threshold.

23. The computer-readable storage medium of claim 19, wherein the instructions cause the processor to perform:

adjusting the interpolation degree to a higher value in response to detecting that the present CPU loading estimate has decreased.

24. The computer-readable storage medium of claim 19, wherein the instructions cause the processor to perform:

adjusting the interpolation degree to a lower value in response to detecting that the present CPU loading estimate has increased.

25. The computer-readable storage medium of claim 19, wherein determining the interpolation degree based on the present CPU load estimate comprises:

comparing the present CPU loading estimate with one or more predefined CPU load levels, and determining the interpolation degree based on said one or more comparisons, wherein each of the one or more predefined CPU load levels corresponds to a corresponding one of a set of one or more interpolation degrees.

26. The computer-readable storage medium of claim 19, wherein dynamically determining the present CPU loading estimate associated with the song being played by the wavetable synthesizer comprises:

while playing the song, detecting that a new voice has been set active;

determining an additional CPU load value that corresponds to the new voice; and adding the additional CPU load value to an accumulated CPU loading estimate that represents the present CPU loading estimate.

27. The computer-readable storage medium of claim 26, wherein determining the additional CPU load value that corresponds to the new voice comprises:

using an identity of the new voice to access and retrieve the additional CPU load value from a memory.

* * * * *

UNITED STATES PATENT AND TRADEMARK OFFICE

CERTIFICATE OF CORRECTION

PATENT NO. : 7,038,119 B2
APPLICATION NO. : 10/621459
DATED : May 2, 2006
INVENTOR(S) : Andrej Petef It is certified that error appears in the above-identified patent and that said Letters Patent is hereby corrected as shown below:

Column 8, Line 59: Change “can Choose” to --can choose--

Column 9, Line 34: Change “lation_degree_11< _Lin_Int_limit”
To --lation_degree_11<Lin_Int_limit--

Claim 19, Line 6: Change “with a sons” to --with a song--

Signed and Sealed this

Twenty-sixth Day of December, 2006

JON W. DUDAS
*Director of the United States Patent and Trademark Office*